US008757981B2

(12) United States Patent
Wiebe

(10) Patent No.: US 8,757,981 B2
(45) Date of Patent: Jun. 24, 2014

(54) LOCKING SPACER ASSEMBLY FOR A TURBINE ENGINE

(75) Inventor: David J. Wiebe, Orlando, FL (US)

(73) Assignee: Siemens Aktiengesellschaft, München (DE)

( * ) Notice: Subject to any disclaimer, the term of this patent is extended or adjusted under 35 U.S.C. 154(b) by 518 days.

(21) Appl. No.: 13/096,051

(22) Filed: Apr. 28, 2011

(65) Prior Publication Data

US 2012/0275918 A1 Nov. 1, 2012

(51) Int. Cl.
*F01D 5/32* (2006.01)
*F01D 5/30* (2006.01)

(52) U.S. Cl.
CPC ..... *F01D 5/3038* (2013.01); *F01D 5/32* (2013.01); *F01D 5/323* (2013.01)
USPC ..... 416/215; 416/220 R

(58) Field of Classification Search
USPC ..... 416/215, 220 R
See application file for complete search history.

(56) References Cited

U.S. PATENT DOCUMENTS

| | | | | |
|---|---|---|---|---|
| 7,435,055 | B2 | 10/2008 | Hanson et al. | |
| 2009/0220345 | A1 * | 9/2009 | Krutzfeldt et al. | 416/220 R |
| 2010/0074731 | A1 | 3/2010 | Weibe et al. | |

* cited by examiner

*Primary Examiner* — Dwayne J White

(57) ABSTRACT

A locking spacer assembly for filling a void between adjacent components in a turbine engine. In at least one embodiment, the locking spacer assembly may be configured to be inserted between adjacent turbine blades in a disc groove in a turbine blade stage assembly. The locking spacer assembly may be formed from radially inward and outward supports coupled together with a locking device. The inward and outward supports establish the desired spacing between adjacent blade supports. The locking device may include components that prevent the locking device from accidentally loosening during use.

20 Claims, 5 Drawing Sheets

LOCKING SPACER ASSEMBLY FOR A TURBINE ENGINE

FIELD OF THE INVENTION

This invention is directed generally to locking spacer assemblies usable in turbine engines, and more particularly to locking spacer assemblies usable in turbine engines for locking a row of blades, such as turbine blades or compressor blades, in place on a turbine stage assembly or a compressor stage assembly, respectively.

BACKGROUND

Typically, gas turbine engines include a compressor for compressing air, a combustor for mixing the compressed air with fuel and igniting the mixture, and a turbine section including a turbine blade assembly for producing power. The compressor and turbine sections of a turbine engine typically include rotors to which a plurality of blades are attached. The plurality of blades are typically arranged in rows spaced axially along the rotor. Each blade is releasably attached to the periphery of a disc.

Instead, spacers formed from multiple components that can be locked into positioned without being rotated into a final position have been used. In some conventional systems, a multi-piece spacer has been used. However, centrifugal forces encountered during operation of the turbine engine can cause these multi-piece spacers to come apart and cause extensive damage to the turbine engine. Conventional designs often suffer from the devices coming apart if either side of the devices develop clearance relative to adjacent turbine components. Another problem often encountered in conventional designs is that the components forming the conventional design often have problems fitting together. Thus, a need exists for a more efficient and reliable device for filling a void between adjacent turbine components and for securing a final spacer for locking turbine blades to a disc.

SUMMARY OF THE INVENTION

This invention relates to a is directed to a locking spacer assembly usable to fill a void in a turbine component slot having lateral recesses. In at least one embodiment, the locking spacer assembly may be configured to be a final component installed in a disc groove to prevent a plurality of blades, such as but not limited to, compressor blades and turbine blades, from detaching from a disc in a blade assembly. The locking spacer assembly may be configured such that the disc groove be continuous throughout its length, circumferential, and need not include a portion having a different configuration for attachment of the locking spacer assembly. The locking spacer assembly may be installed and actuated without interaction with adjacent turbine blades, thereby preventing failure if clearance develops on either side of the assembly proximate to the adjacent blades. The locking spacer assembly may remain assembled and in place during all operating stages of a turbine engine.

The locking spacer assembly for filling a void in a turbine component having lateral recesses may include a radially outward support having an outer surface, a forward sloped inner face, an aft sloped inner face and an inwardly extending spacer protrusion. The radially outward support may include one or more locking orifices extending therethrough. The locking orifice in the radially outward support may be countersunk such that the locking device may fit within the radially outward support and may not extend radially outward beyond the outer surface of the radially outward support. The radially outward support may be configured to engage radially outward facing surfaces on a disc. The radially outward support may include an aft contact surface that protrudes radially inward from the aft sloped inner face such that the aft contact surface contacts a disc. The radially outward support may include a forward contact surface that protrudes radially inward from the forward sloped inner face such that the forward contact surface contacts the disc.

The locking spacer assembly may include a radially inward support having an outer surface with a forward disc receiving recess and an aft receiving recess for receiving a portion of a disc arm. The radially inward support may include at least one locking orifice extending therethrough. The radially inward support may be sized such that a gap exists between a radially inner surface of the radially inward support and a radially outward facing surface of the disc forming a disc groove in which the radially inward and outward supports are positioned. In addition, a gap may exist between the inwardly extending spacer protrusion and a surface of the disc positioned forward of the radially outward support. A gap may also exist between the inwardly extending spacer protrusion and a surface of the disc positioned aft of the radially outward support.

The locking spacer assembly may also include a locking device extending through the locking orifice in the radially outward support and extending at least partially into the locking orifice in the radially inward support. In one embodiment, the locking device may be a bolt having at least one recess in an outer side surface of a bolt head on the bolt. The locking device may include at least one washer having a generally linear surface with at least one protruding side wall extending radially in a first direction. The at least one protruding side wall may include an inward protruding stop that rests with the recess in the outer side surface of the bolt head. The washer may include a stop arm extending radially from the generally linear surface in a direction generally away from the protruding side wall. The stop arm may rest within a slot in the radially outward support, which prevents the washer and the bolt from being accidentally loosened. The at least one recess may be formed from a plurality of recesses in the bolt head. The inward protruding stop may be formed from at least two opposing stops extending into the recesses in the protruding side wall. A self locking helical coil insert may be positioned in the locking orifice extending through the radially inward support.

In another embodiment, the locking device may be a bolt having at least one torque slot in an outer side surface of a bolt head on the bolt. The side surface forming the locking orifice in the radially outward support may include at least one locking pin receiving cavity. The bolt may include a plurality of torque slots in the outer side surface of the bolt head on the bolt, and the side surface forming the locking orifice in the radially outward support may include a plurality of locking pin receiving cavities.

In yet another embodiment, the locking device may be a bolt having at least one torque slot in an outer side surface of a bolt head on the bolt. A side surface forming the locking orifice in the radially outward support may include at least one torque lug slot offset from side surface. The locking device may be a bolt having a plurality of torque slots in an outer side surface of a bolt head on the bolt. The side surface forming the locking orifice in the radially outward support may include a plurality of torque lug slots offset from side surface.

The forward disc receiving recess may be positioned on a corner forming an intersection between the outer surface and a forward side surface. In addition, the aft disc receiving recess may be positioned on a corner forming an intersection between the outer surface and an aft side surface.

In another embodiment, a method of securing blades to a component of a turbine engine with a locking spacer assembly is disclosed. The method may include inserting a radially inward support into a disc groove, wherein the radially inward support has an outer surface with a forward disc receiving recess and an aft receiving recess for receiving a portion of a disc arm. The radially inward support may includes at least one locking orifice extending therethrough. The method may also include positioning a radially outward support having an outer surface, a forward sloped inner face, an aft sloped inner face and an inwardly extending spacer protrusion, wherein the radially outward support includes at least one locking orifice extending therethrough and wherein the radially outward support is configured to engage radially outward facing surfaces on a disc. The method may also include inserting a locking device into the locking orifice in the radially outward support and extending at least partially into the locking orifice in the radially inward support. In addition, the method may include locking the locking device in place so that the locking device may not accidentally loosen.

An advantage of this invention is that the locking spacer assembly provides direct clamping between the forward contact surface, the aft contact surface and the forward and aft disc receiving recesses on the radially inward support.

Another advantage of this invention is that the locking spacer assembly includes a locking device with a locking washer that can be bent into recesses in a bolt head without having to rotate the bolt head for alignment, thereby preventing the loss of pre-loaded tension.

Yet another advantage of this invention is that the locking device of the locking spacer assembly may be a single pin that locks the locking device in place to prevent accidently loosening.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
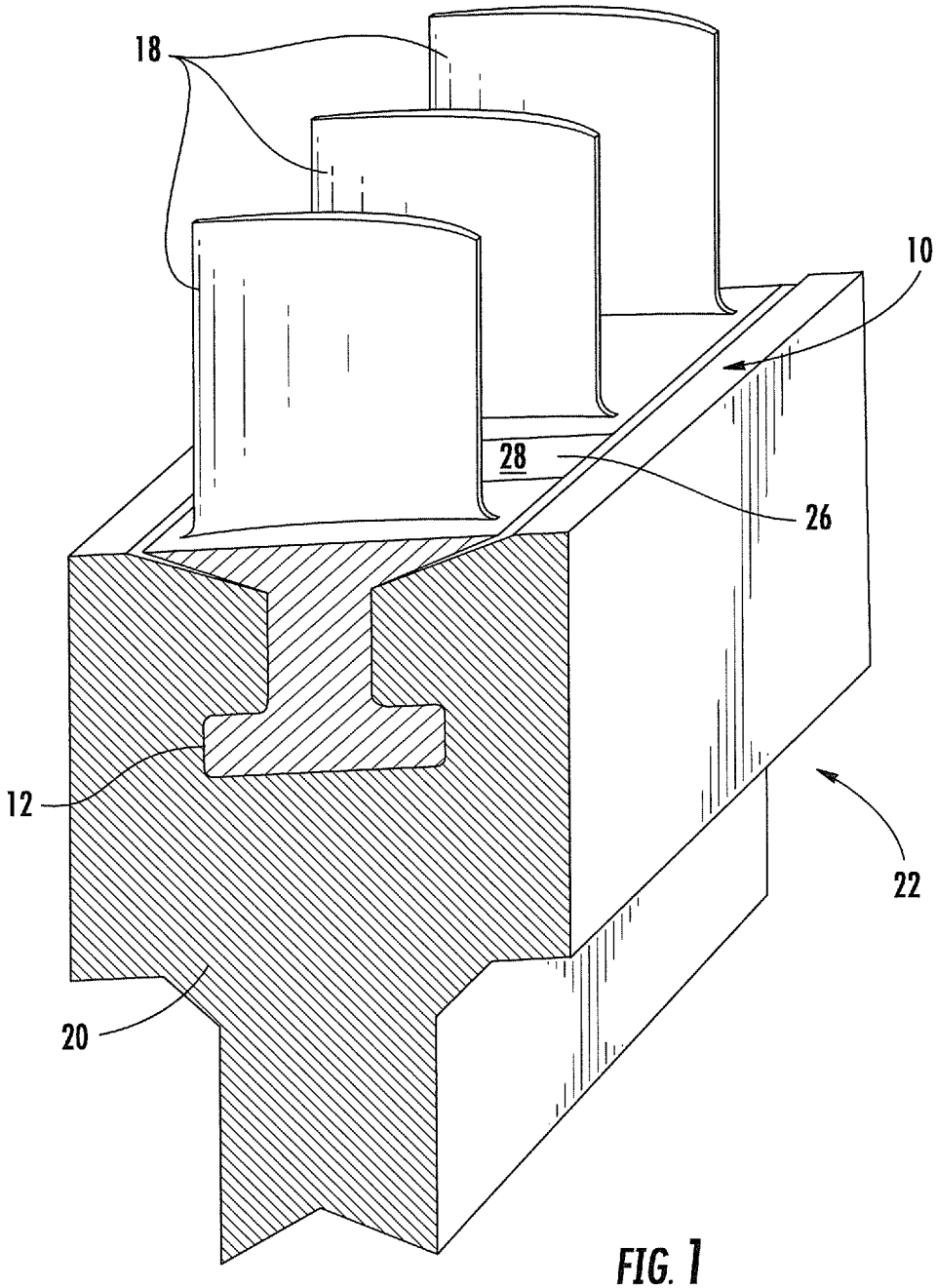
FIG. 1 is a perspective view of a partial stage assembly including a disc, a plurality of blades, and a locking spacer assembly.

As shown in FIGS. 1-9, this invention is directed to a locking spacer assembly 10 usable to fill a void 24 in a turbine component slot 12 having lateral recesses 14. In at least one embodiment, the locking spacer assembly 10 may be configured to be a final component installed in a disc groove 16 to prevent a plurality of blades 18, such as but not limited to, compressor blades and turbine blades, from detaching from a disc 20 in a blade assembly 22. The locking spacer assembly 10 may be configured such that the disc groove 16 be continuous throughout its length, circumferential, and need not include a portion having a different configuration for attachment of the locking spacer assembly 10. The locking spacer assembly 10 may be installed and actuated without interaction with adjacent turbine blades 18, thereby preventing failure if clearance develops on either side of the assembly 10 proximate to the adjacent blades 18. The locking spacer assembly 10 may remain assembled and in place during all operating stages of a turbine engine.

Figure 3:
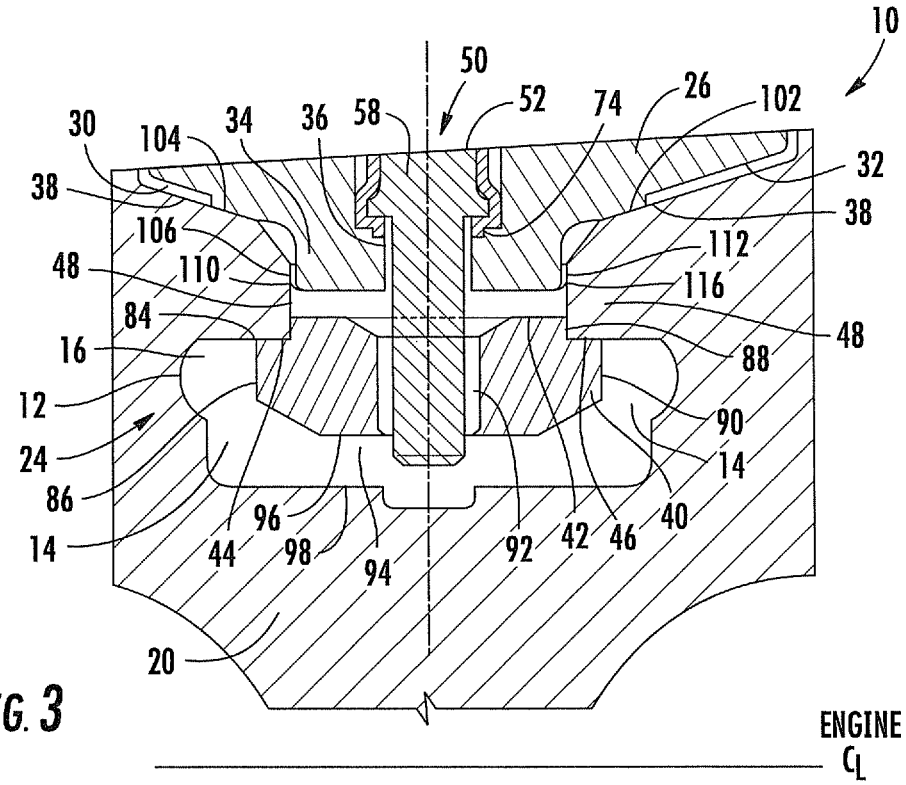
FIG. 3 is a side view of the locking spacer assembly of this invention.
Figure 4:
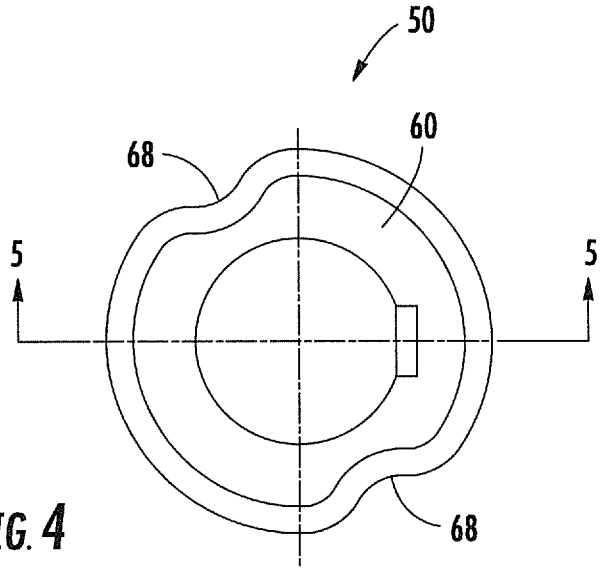
FIG. 4 is top view of a washer that is a part of the locking device usable in the locking spacer assembly.

The locking spacer assembly 10 may be formed from a radially outward support 26 having an outer surface 28, a forward sloped inner face 30, an aft sloped inner face 32 and an inwardly extending spacer protrusion 34. The inwardly extending spacer protrusion 34 may separate the forward and aft sloped inner faces 30, 32 and may extend from the radially outward support 26 further than the forward and aft sloped inner faces 30, 32. The radially outward support 26 may include one or more locking orifices 36 extending therethrough. The radially outward support 26 may be configured to engage radially outward facing surfaces 38 on a disc 20. The radially outward support 26 may be coupled to a radially inward support 40 having an outer surface 42 with a forward disc receiving recess 44 and an aft disc receiving recess 46 for receiving a portion of a disc arm 48. The radially inward support 40 may include one or more locking orifices 36 extending therethrough. The locking orifice 36 in the radially outward support 26 may be countersunk such that the locking device 50 may fit within the radially outward support 26 and not extending radially outward beyond the outer surface 28 of the radially outward support 26. In at least one embodiment, as shown in FIG. 3, a self locking helical coil insert 92 may be positioned in the locking orifice 36 extending through the radially inward support 40.

Figure 2:
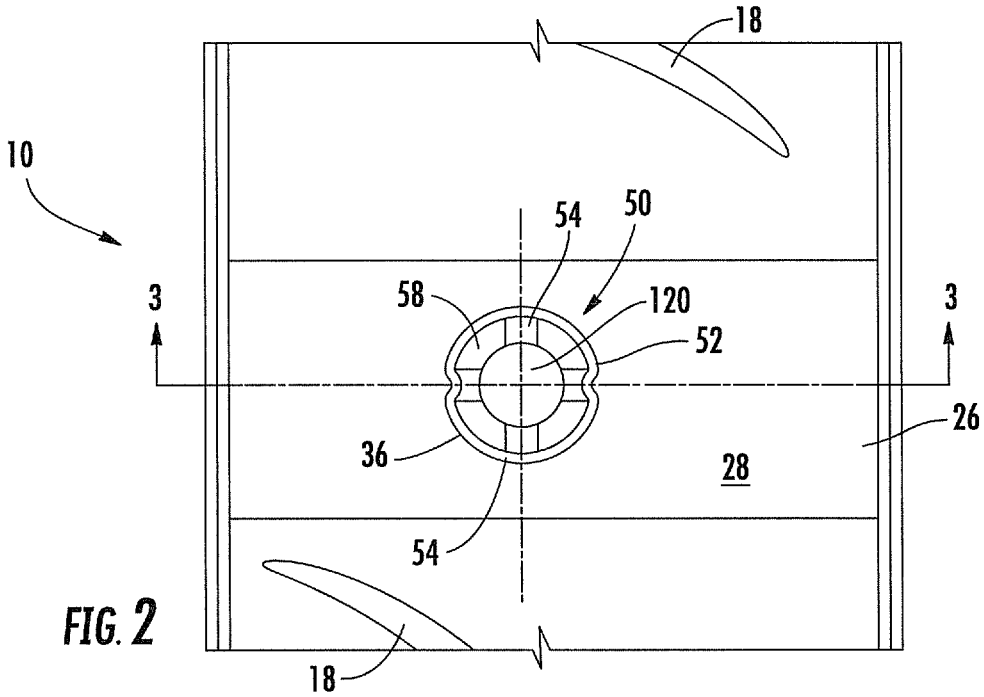
FIG. 2 is a top view of the locking spacer assembly of this invention installed in a stage assembly.

A locking device 50 may extend through the locking orifice 36 in the radially outward support 26 and extending at least partially into the locking orifice 36 in the radially inward support 40. In one embodiment, as shown in FIG. 3, the locking device 50 may be a bolt 52 having at least one recess 54 in an outer side surface 56 of a bolt head 58 on the bolt 52. The locking device 50 may include one or more washers 60 having a generally linear surface 62 with one or more protruding side walls 64 extending radially in a first direction 66. The protruding side wall 64 may include an inward protruding stop 68 that rests with the recess 54 in the outer side surface 56 of the bolt head 58. The washer 60 may include a stop arm 70 extending radially from the generally linear surface 62 in a direction 72 generally away from the at least one protruding side wall 64 extending the first direction 66. The stop arm 70 may rest within a slot 74 in the radially outward support 26, which prevents the washer 60 and the bolt 52 from being accidentally loosened. The recess 54 may be formed from a plurality of recesses 54, as shown in FIG. 2. The inward protruding stop 68 may be formed from one or more opposing stops 68 extending into the recesses 54 in the protruding side wall 64. In at least one embodiment, the inward protruding stops 68 may be formed from two or more opposing stops 68. The inward protruding stop 68 may be formed after that washer 60 has been installed and the bolt 52 tightened. As such, the bolt 52 can be tightened to any amount of torque desired. Then, one or more inward protruding stops 68 may be created to push material forming the washer 60 into the recesses 54 in the bold head 58. As such, the bolt 52 may be held in place at any position.

Figure 6:
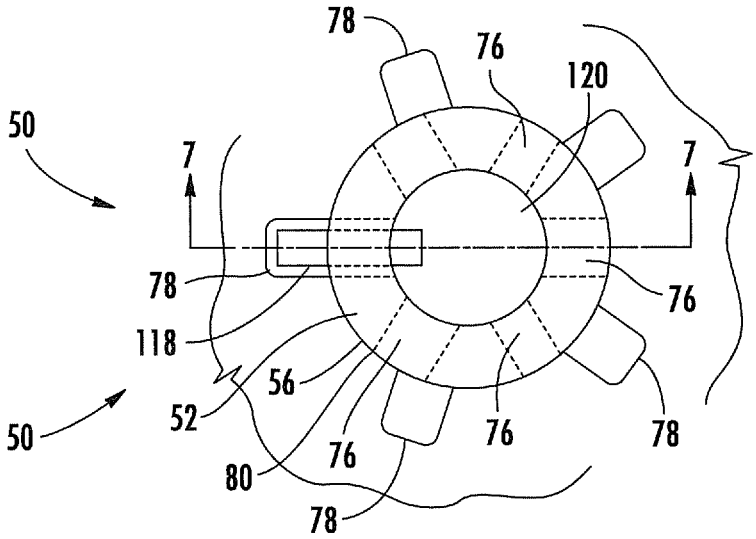
FIG. 6 is a top view of an alternative locking device usable in the locking spacer assembly.
Figure 7:
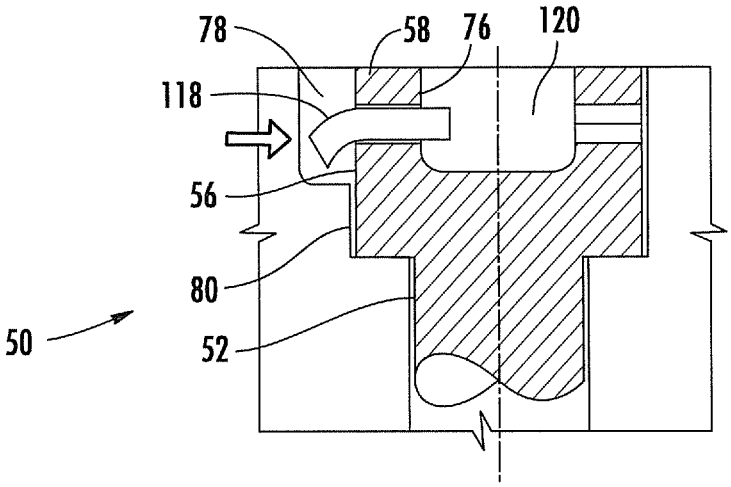
FIG. 7 is a cross-sectional view taken along section line 7-7 in FIG. 6.
Figure 8:
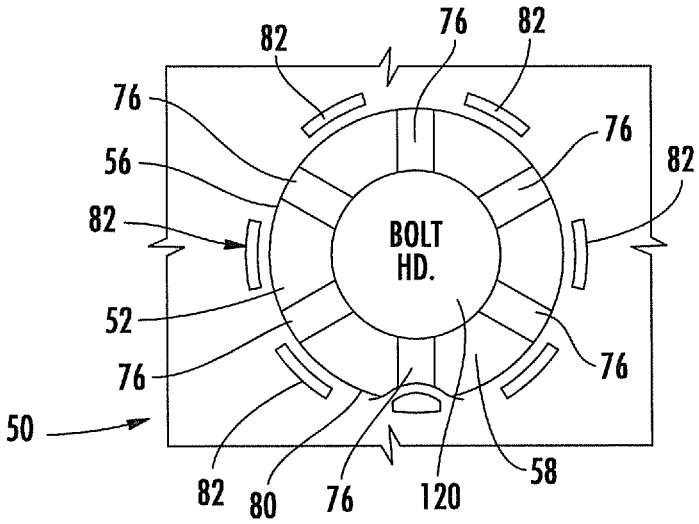
FIG. 8 is a top view of another alternative locking device usable in the locking spacer assembly.

In another embodiment, as shown in FIGS. 6-8, the locking device 50 may be configured such that little rotation of a bolt 52 need be made to position the bold 52 such that the bolt 52 can be secured. In particular, the bolt 52 may include a plurality of slots 76, and the side surface 80 forming the locking orifice 36 surrounding the bolt head 58 may include a plurality of protrusions, which may be a formed from a locking pin receiving cavity 78, a torque lug slot 82 or other appropriate device. The number of slots 76 may differ from the number of protrusions in the side surface 80. For instance, the number of slots 76 to protrusions may be 4 to 6, 5 to 7, 5 to 9, 5 to 6, 7 to 6 or other appropriate configurations. Having a differential between the number of slots 76 and the protrusions reduces the amount of additional rotation required to secure the bolt. As such, such a differential enables a reduced amount of turn, either extra tightening or loosening, to achieve alignment between a slot and a protrusion, thereby reducing the amount of deviation from a desired torque and angle of turn.

For instance, as shown in FIGS. 6 and 7, the locking device 50 may be a bolt 52 having one or more torque slots 76 in an outer side surface 56 of a bolt head 58 on the bolt 52. The side surface 80 forming the locking orifice 36 in the radially outward support 26 may include one or more locking pin receiving cavities 78. In another embodiment, the bolt 52 may include a plurality of torque slots 76 in the outer side surface 56 of the bolt head 58 on the bolt 52. The side surface 80 forming the locking orifice 36 in the radially outward support 26 may include a plurality of locking pin receiving cavities 78. In the embodiment shown in FIG. 6, there are six torque slots 76 evenly spaced in the bolt head 58 and five locking pin receiving cavities 78 evenly spaced in the radially outward support 26. As such, the bolt head 58 is only required to be rotated at most 12 degrees, clockwise or counter clockwise, to be aligned with a locking pin receiving cavity 78. Once a torque slot 76 is aligned with a locking pin receiving cavity 78, a locking pin 118 may be inserted through the torque slot 76 and into the locking pin receiving cavity 78. The locking pin 118 may be a single pin and may be formed from any appropriate material.

In still another embodiment, as shown in FIG. 8, the locking device 50 is a bolt 52 having one or more torque slots 76 in an outer side surface 56 of a bolt head 58 on the bolt 52. A side surface 80 forming the locking orifice 36 in the radially outward support 26 may include one or more torque lug slots 82 offset from the side surface 80. In yet another embodiment, the locking device 50 may be a bolt 52 having a plurality of torque slots 76 in an outer side surface 56 of the bolt head 58 on the bolt 52. The side surface 80 forming the locking orifice 36 in the radially outward support 26 may include a plurality of torque lug slots 82 offset from the side surface 80. In the embodiment shown in FIG. 8, there are six torque slots 76 evenly spaced in the bolt head 58 and seven torque lug slots 82 evenly spaced in the radially outward support 26. As such, the bolt head 58 is only required, clockwise or counter clockwise, to be rotated at most 4.3 degrees to be aligned with a torque lug slot 82.

Figure 9:
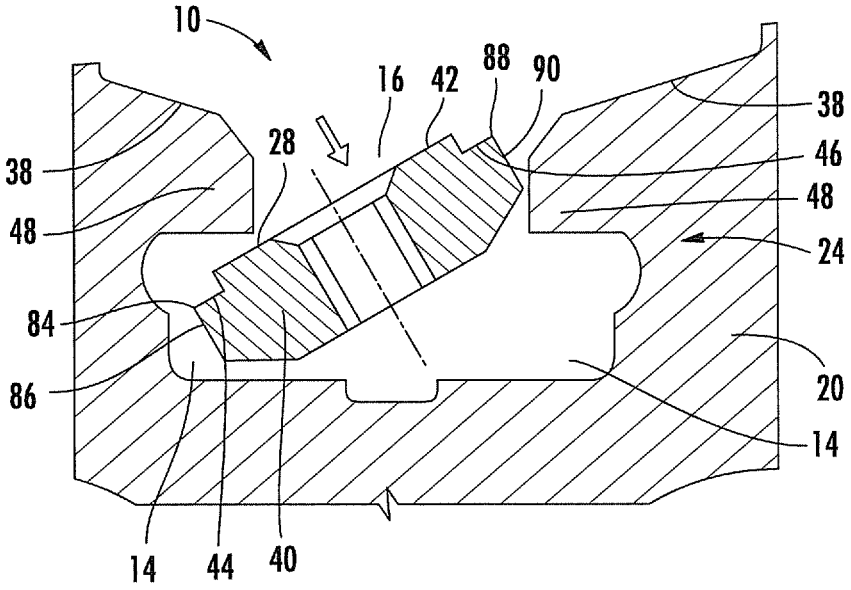
FIG. 9 is a partial side view of a radially inward support being installed in a void in the disc.

As shown in FIG. 9, the forward disc receiving recess 44 may be positioned on a corner 84 forming an intersection between the outer surface 28 and a forward side surface 86. The aft disc receiving recess 46 may be positioned on a corner 88 forming an intersection between the outer surface 28 and an aft side surface 90. The distance between the corners 84, 88 is sized to be approximately equal to a distance between opposing disc arms 48.

The radially inward support 40 may be sized such that a gap 94 exists between a radially inner surface 96 of the radially inward support 40 and a radially outward facing surface 98 of the disc 20 forming the disc groove 16 in which the radially inward and outward supports 40, 26 are positioned. The radially outward support 26 may include an aft contact surface 102 that protrudes radially inward from the aft sloped inner face 32 such that the aft contact surface 102 contacts the disc 20. The radially outward support 26 may also include a forward contact surface 104 that protrudes radially inward from the forward sloped inner face 30 such that the forward contact surface 104 contacts the disc 20. A gap 106 may exist between the inwardly extending spacer protrusion 34 and a surface 110 of the disc 20 positioned forward of the radially outward support 26. A gap 112 may exist between the inwardly extending spacer protrusion 34 and a surface 116 of the disc 20 positioned aft of the radially outward support 26.

The locking spacer assembly 10 may be installed in place after all blades within a particular stage have been installed. The radially inward support 40 may be inserted into the void 24 in the disc 20 by inserting into a radially inner portion 80 of the void 24 and rotating the radially inward support 40 about 90 degrees such that the forward sloped inner face 30 and the aft sloped inner face 32 are aligned to contact the disc arms 48. The radially outward support 26 may then be positioned in the void 24 radially outward from the radially inward support 40. A locking device 50 may be installed to couple the radially outward support 26 and the radially inward support 40 together. In at least one embodiment, a bolt 52 may be inserted into the locking orifice 36 of the radially outward support 26 and into the radially inward support 40. The bolt 52 may be rotated to draw the radially outward support 26 and the radially inward support 40 into contact with the disc arm 48. In particular, the forward and aft disc receiving recesses 44, 46 may receive portions of the disc arm 48. The aft and forward contact surfaces 102, 104 of the radially outward support 26 contact an outer surface of the disc 20.

Figure 5:
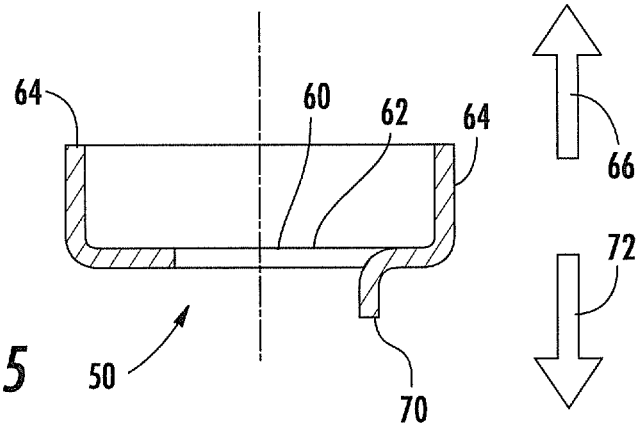
FIG. 5 is a cross-sectional view taken along section line 5-5 in FIG. 4.

The bolt 52 may be secured in position using one or more of the locking mechanisms disclosed herein or other appropriate devices. As shown in FIG. 5, the bolt 52 may be rotated until the stop arm 70 rests within the slot 74 and the inward protruding stops 68 are moved into the recesses 54 in the outer side surface 56 of the bolt head 58, which prevents the washer 60 and the bolt 52 from being accidentally loosened. In another embodiment, as shown in FIG. 7, a locking pin 118 may be inserted into a center cavity 120 in the bolt head 58, moved into a torque slot 76 in an outer side surface 56 of a bolt head 58 on the bolt 52 and into a locking pin receiving cavity 78. The locking pin 118 may be bent in the locking pin receiving cavity 78 to keep the locking pin 118 in position. In still another embodiment, as shown in FIG. 8, once a torque slot 76 has been aligned with a torque lug slot 82, a tool, such as, but not limited to a punch or screwdriver, may be inserted into the torque lug slot 82 to move a portion of the material between the torque lug slot 82 and an outer surface of forming the locking orifice 36 into the torque slot 76 to prevent the bolt 52 from loosening.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A locking spacer assembly for filling a void in a turbine component having lateral recesses, comprising:

a radially outward support having an outer surface, a forward sloped inner face, an aft sloped inner face and an inwardly extending spacer protrusion, wherein the radially outward support includes at least one locking orifice extending therethrough and wherein the radially outward support is configured to engage radially outward facing surfaces on a disc;

a radially inward support having an outer surface with a forward disc receiving recess and an aft receiving recess for receiving a portion of a disc arm, wherein the radially inward support includes at least one locking orifice extending therethrough;

a locking device extending through the at least one locking orifice in the radially outward support and extending at least partially into the at least one locking orifice in the radially inward support; and wherein the locking device is a bolt having at least one recess in an outer side surface of a bolt head on the bolt and wherein the locking device includes at least one washer having a generally linear surface with at least one protruding side wall extending radially in a first direction, wherein the at least one protruding side wall includes an inward protruding stop that rests with the at least one recess in the outer side surface of the bolt head, wherein the at least one washer includes a stop arm extending radially from the generally linear surface in a direction generally away from the at least one protruding side wall, and wherein the stop arm rests within a slot in the radially outward support, which prevent the at least one washer and at least one bolt from being accidentally loosened.

2. The locking spacer assembly of claim 1, wherein the at least one recess is formed from a plurality of recesses.

3. The locking spacer assembly of claim 2, wherein the inward protruding stop is formed from at least two opposing stops extending into the recesses in the at least one protruding side wall.

4. The locking spacer assembly of claim 1, wherein the forward disc receiving recess is positioned on a corner forming an intersection between the outer surface and a forward side surface.

5. The locking spacer assembly of claim 1, wherein the aft disc receiving recess is positioned on a corner forming an intersection between the outer surface and an aft side surface.

6. The locking spacer assembly of claim 1, wherein the at least one locking orifice in the radially outward support is countersunk such that the locking device may fit within the radially outward support and not extending radially outward beyond the outer surface of the radially outward support.

7. The locking spacer assembly of claim 1, wherein the radially inward support is sized such that a gap exists between a radially inner surface of the radially inward support and a radially outward facing surface of the disc forming a disc groove in which the radially inward and outward supports are positioned.

8. The locking spacer assembly of claim 1, wherein the radially outward support includes an aft contact surface that protrudes radially inward from the aft sloped inner face such that the aft contact surface contacts the disc, and wherein the radially outward support includes a forward contact surface that protrudes radially inward from the forward sloped inner face such that the forward contact surface contacts the disc.

9. A locking spacer assembly for filling a void in a turbine component having lateral recesses, comprising:

a radially outward support having an outer surface, a forward sloped inner face, an aft sloped inner face and an inwardly extending spacer protrusion, wherein the radially outward support includes at least one locking orifice extending therethrough and wherein the radially outward support is configured to engage radially outward facing surfaces on a disc;

a radially inward support having an outer surface with a forward disc receiving recess and an aft receiving recess for receiving a portion of a disc arm, wherein the radially inward support includes at least one locking orifice extending therethrough;

a locking device extending through the at least one locking orifice in the radially outward support and extending at least partially into the at least one locking orifice in the radially inward support; and wherein the locking device is a bolt having at least one torque slot in an outer side surface of a bolt head on the bolt, and wherein a side surface forming the at least one locking orifice in the radially outward support includes at least one locking pin receiving cavity.

10. The locking spacer assembly of claim 9, wherein the bolt includes a plurality of torque slots in the outer side surface of the bolt head on the bolt, and the side surface forming the at least one locking orifice in the radially outward support includes a plurality of locking pin receiving cavities.

11. A locking spacer assembly for filling a void in a turbine component having lateral recesses, comprising:

a radially outward support having an outer surface, a forward sloped inner face, an aft sloped inner face and an inwardly extending spacer protrusion, wherein the radially outward support includes at least one locking orifice extending therethrough and wherein the radially outward support is configured to engage radially outward facing surfaces on a disc;

a radially inward support having an outer surface with a forward disc receiving recess and an aft receiving recess for receiving a portion of a disc arm, wherein the radially inward support includes at least one locking orifice extending therethrough;

a locking device extending through the at least one locking orifice in the radially outward support and extending at least partially into the at least one locking orifice in the radially inward support; and wherein the locking device is a bolt having at least one torque slot in an outer side surface of a bolt head on the bolt, and wherein a side surface forming the at least one locking orifice in the radially outward support includes at least one torque lug slot offset from the side surface.

12. The locking spacer assembly of claim 11, wherein the locking device is a bolt having a plurality of torque slots in an outer side surface of a bolt head on the bolt, and wherein a side surface forming the at least one locking orifice in the radially outward support includes a plurality of torque lug slots offset from the side surface.

13. A locking spacer assembly for filling a void in a turbine component having lateral recesses, comprising:

a radially outward support having an outer surface, a forward sloped inner face, an aft sloped inner face and an inwardly extending spacer protrusion, wherein the radially outward support includes at least one locking orifice extending therethrough and wherein the radially outward support is configured to engage radially outward facing surfaces on a disc;

a radially inward support having an outer surface with a forward disc receiving recess and an aft receiving recess for receiving a portion of a disc arm, wherein the radially inward support includes at least one locking orifice extending therethrough;

a locking device extending through the at least one locking orifice in the radially outward support and extending at least partially into the at least one locking orifice in the radially inward support; and further comprising a self locking helical coil insert positioned in the at least one locking orifice extending through the radially inward support.

14. The locking spacer assembly of claim 13, wherein the at least one locking orifice in the radially outward support is countersunk such that the locking device may fit within the radially outward support and not extending radially outward beyond the outer surface of the radially outward support.

15. The locking spacer assembly of claim 13, wherein the radially inward support is sized such that a gap exists between a radially inner surface of the radially inward support and a radially outward facing surface of the disc forming a disc groove in which the radially inward and outward supports are positioned.

16. The locking spacer assembly of claim 13, wherein the radially outward support includes an aft contact surface that protrudes radially inward from the aft sloped inner face such that the aft contact surface contacts the disc, and wherein the radially outward support includes a forward contact surface that protrudes radially inward from the forward sloped inner face such that the forward contact surface contacts the disc.

17. A locking spacer assembly for filling a void in a turbine component having lateral recesses, comprising:

a radially outward support having an outer surface, a forward sloped inner face, an aft sloped inner face and an inwardly extending spacer protrusion, wherein the radially outward support includes at least one locking orifice extending therethrough and wherein the radially outward support is configured to engage radially outward facing surfaces on a disc;

a radially inward support having an outer surface with a forward disc receiving recess and an aft receiving recess for receiving a portion of a disc arm, wherein the radially inward support includes at least one locking orifice extending therethrough;

a locking device extending through the at least one locking orifice in the radially outward support and extending at least partially into the at least one locking orifice in the radially inward support; and wherein a gap exists between the inwardly extending spacer protrusion and a surface of the disc positioned forward of the radially outward support, and a gap exists between the inwardly extending spacer protrusion and a surface of the disc positioned aft of the radially outward support.

18. A locking spacer assembly for filling a void in a turbine component having lateral recesses, comprising:

a radially outward support having an outer surface, a forward sloped inner face, an aft sloped inner face and an inwardly extending spacer protrusion, wherein the radially outward support includes at least one locking orifice extending therethrough and wherein the radially outward support is configured to engage radially outward facing surfaces on a disc;

a radially inward support having an outer surface with a forward disc receiving recess and an aft receiving recess for receiving a portion of a disc arm, wherein the radially inward support includes at least one locking orifice extending therethrough, wherein the forward disc receiving recess is positioned on a corner forming an intersection between the outer surface and a forward side surface, and wherein the aft disc receiving recess is positioned on a corner forming an intersection between the outer surface and an aft side surface; and a locking device extending through the at least one locking orifice in the radially outward support and extending at least partially into the at least one locking orifice in the radially inward support;

wherein the at least one locking orifice in the radially outward support is countersunk such that the locking device may fit within the radially outward support and not extending radially outward beyond the outer surface of the radially outward support;

wherein the radially outward support includes an aft contact surface that protrudes radially inward from the aft sloped inner face such that the aft contact surface contacts the disc, and wherein the radially outward support includes a forward contact surface that protrudes radially inward from the forward sloped inner face such that the forward contact surface contacts the disc; and wherein the locking device is a bolt having at least one recess in an outer side surface of a bolt head on the bolt and wherein the locking device includes at least one washer having a generally linear surface with at least one protruding side wall extending radially in a first direction, wherein the at least one protruding side wall includes an inward protruding stop that rests with the at least one recess in the outer side surface of the bolt head, wherein the at least one washer includes a stop arm extending radially from the generally linear surface in a direction generally away from the at least one protruding side wall, and wherein the stop arm rests within a slot in the radially outward support, which prevent the at least one washer and at least one bolt from being accidentally loosened.

19. The locking spacer assembly of claim 18, wherein the locking device is a bolt having at least one torque slot in an outer side surface of a bolt head on the bolt, and wherein a side surface forming the at least one locking orifice in the radially outward support includes at least one locking pin receiving cavity.

20. The locking spacer assembly of claim 18, wherein the locking device is a bolt having at least one torque slot in an outer side surface of a bolt head on the bolt, and wherein a side surface forming the at least one locking orifice in the radially outward support includes at least one torque lug slot offset from side surface.

* * * * *